US010487530B1

(12) United States Patent
Jun

(10) Patent No.: US 10,487,530 B1
(45) Date of Patent: Nov. 26, 2019

(54) FOLDING HEXAGONAL TENT

(71) Applicant: Byungtae Jun, Daegu (KR)

(72) Inventor: Byungtae Jun, Daegu (KR)

( * ) Notice: Subject to any disclaimer, the term of this patent is extended or adjusted under 35 U.S.C. 154(b) by 0 days.

(21) Appl. No.: 16/249,038

(22) Filed: Jan. 16, 2019

(30) Foreign Application Priority Data

May 1, 2018 (KR) ..... 10-2018-0050307

(51) Int. Cl.
*E04H 15/46* (2006.01)
*E04H 15/50* (2006.01)

(52) U.S. Cl.
CPC ..... *E04H 15/46* (2013.01); *E04H 15/50* (2013.01)

(58) Field of Classification Search
CPC ..... E04H 15/322; E04H 15/46; E04H 15/48; E04H 15/50
See application file for complete search history.

(56) References Cited

U.S. PATENT DOCUMENTS 4,779,635 A * 10/1988 Lynch ..... E04H 15/50 135/145
5,244,001 A * 9/1993 Lynch ..... E04H 15/50 135/145
5,490,532 A * 2/1996 Mallookis ..... E04H 15/50 135/114
5,794,640 A * 8/1998 Jang ..... E04H 15/50 135/131
6,152,157 A * 11/2000 Jang ..... E04H 15/50 135/131
7,422,026 B2 * 9/2008 Kim ..... E04H 15/50 135/120.2
9,574,368 B2 * 2/2017 Kayser ..... E04H 15/44
9,790,705 B2 * 10/2017 Lyon ..... E04H 15/48
9,809,993 B2 * 11/2017 Carter ..... E04H 15/48
2004/0079406 A1 * 4/2004 Byun ..... E04H 15/50 135/131
2014/0099155 A1 * 4/2014 Chen ..... E04H 15/46 403/83

FOREIGN PATENT DOCUMENTS

KR 20-0206762 Y1 12/2000
KR 20-0285444 Y1 8/2002
KR 20-0339334 Y1 1/2004

* cited by examiner

*Primary Examiner* — David R Dunn
*Assistant Examiner* — Danielle Jackson
(74) *Attorney, Agent, or Firm* — Korus Patent, LLC; Seong Il Jeong

(57) ABSTRACT

A folding hexagonal tent includes: posts (2) disposed on respective vertices of a tent, and configured to support the tent; side frames (3) formed in rectilinear shapes, and coupled such that both ends of each of the side frames (3) are hinged to adjacent two of the posts and such that each of the side frames (3) is connected to selectively increase and decrease a distance between the adjacent two posts (2); a roof frame (4) configured to vertically support the center portion of the tent; and connecting frames (5) formed in rectilinear shapes, and coupled such that the first ends thereof are hinged to the respective tops of the posts (2) and the second ends thereof are hinged to the bottom of the roof frame (4) and such that the connecting frames (5) are connected to selectively increase and decrease distances between the posts and the roof frame.

4 Claims, 9 Drawing Sheets

(A)

(B)

(C)

FOLDING HEXAGONAL TENT

CROSS-REFERENCE TO RELATED APPLICATION

This application claims the benefit of Korean Patent Application No. 10-2018-0050307 filed on May 1, 2018, which is hereby incorporated by reference herein in its entirety.

BACKGROUND

1. Technical Field

The present invention relates generally to a folding hexagonal tent, and more specifically to a folding hexagonal tent, in which posts are connected by foldable frames having the same length by using a three-point support method, thereby preventing a tent skeleton from being twisted, improving the convenience of assembly, and also providing a wide awning space.

2. Description of the Related Art

In general, as shown in FIG. 1, a conventional folding tent that is used to avoid sunlight and rain includes: four posts A configured to be selectively extended and retracted and to support the tent on a support surface; side frames B configured to rotatably intersect each other in an "X" shape between the posts A; a roof frame C configured to support the center portion of the roof of the tent; and connecting frames D configured to connect the side frames B and the roof frame C and to rotatably intersect each other in an "X" shape.

The conventional folding tent is widely used in a variety of outdoor events because, due to the foldable structures of the side frames B and the connecting frames D, when the posts A are collected around the roof frame C, the volume of the tent is reduced and thus the tent can be easily carried and stored, and, when the posts A are spread radially, the tent is spread while forming the spread skeleton of the tent and thus the installation and removal of the tent can be rapidly and conveniently performed.

However, the conventional folding tent has various structural disadvantages:

First, the four posts are provided and disposed at the four corners of a square when viewed in their plan view, and the connecting frames D are coupled between the side frames B, connecting the posts A to each other, and the roof frame C. Accordingly, disadvantages arise in that the conventional tent is highly influenced by a wind and both ends of the side frames B are easily shaken by a wind based on the connecting frames D.

Second, two side frames connecting posts are coupled to both sides of each of the posts and the post is supported by the two side frames by using a two-point support structure, and thus upright stability is insufficient, with the result that a disadvantage arises in that an overall skeleton constituting the tent is twisted as both ends of the side frames B are shaken, and thus the conventional tent falls down easily due to a wind.

Third, the lengths of the side frames B and the connecting frames D are structurally different from each other. Accordingly, in the fabrication of the conventional folding tent, it is necessary that frames having different lengths are manufactured and assembled together, and thus an assembly process is cumbersome and complicated, with the result that disadvantages arise in that manufacturing efficiency is poor and manufacturing cost is high.

Fourth, the conventional tent forms a square when viewed in its plan view, and thus an awning space configured to avoid sunlight and rain under the tent is relatively small, with the result that a disadvantage arises in that the awning space is not efficiently used.

Fifth, when a plurality of tents is installed in close contact with one another in order to form a wide awning space, a form in which conventional tents are connected in close contact with one another is constructed only in vertical and horizontal directions, and thus a disadvantage arises in that it is difficult to construct an awning space in various forms.

RELATED ART DOCUMENT

Patent Document (Patent document 0001) Korean Utility Model Registration No. 20-0206762

SUMMARY

The present invention has been conceived to overcome the above-described problems, and an object of the present invention is to provide a folding hexagonal tent, in which side frames and connecting frames are coupled to posts, and thus the posts are supported by a three-point support method, thereby providing a secure skeleton structure.

Furthermore, an object of the present invention is to provide a folding hexagonal tent, in which side frames and connecting frames that are foldable have the same length.

Furthermore, an object of the present invention is to provide a folding hexagonal tent, which provides a wide awning space.

In order to accomplish the above objects, the present invention provides a folding hexagonal tent, including: posts (2) disposed on the respective vertices of a tent formed in a hexagonal shape in a plan view, and configured to support the tent on a support surface; side frames (3) formed in rectilinear shapes, and coupled such that both ends of each of the side frames (3) are hinged to adjacent two of the posts and such that the side frame (3) is connected to selectively increase and decrease a distance between the adjacent two posts (2); a roof frame (4) configured to vertically support the center portion of the tent; and connecting frames (5) formed in rectilinear shapes, and coupled such that the first ends thereof are hinged to the respective tops of the posts (2) and the second ends thereof are hinged to the bottom of the roof frame (4) and such that the connecting frames (5) are connected to selectively increase and decrease distances between the posts and the roof frame.

The posts (2) may be supported by means of a three-point support method in such that two different ones of the side frames (3) are coupled to both sides of each of the posts (2) and a corresponding one of the connecting frames (5) is coupled at a location that bisects an angle formed by the two side frames (3) in a plan view.

The side frames (3) and the connecting frames (5) may be formed to have the same length.

The roof frame (4) may be configured such that an upper frame (41) having a smaller diameter is accommodated inside a lower frame (42) having a larger diameter in an antenna manner, so that the roof frame (4) is selectively extended and retracted and a height adjustment means (422)

configured to vertically adjust a location of the upper frame (41) is provided at a lower end of the lower frame (42).

The height adjustment means (422) may include: a screw rod (422*a*) vertically installed at a lower end of the lower frame (42) so that it is idly rotatable, and formed such that a lower end of the screw rod (422*a*) protrudes downward from the lower frame (42); a lifting element (422*b*) installed such that the lifting element (422*b*) is coupled around the screw rod (422*a*) in a screw manner and is selectively lifted and lowered inside the lower frame (42) by the rotation of the screw rod (422*a*); and a coil spring (422*c*) configured such that a lower end thereof is fastened to the top portion of the lifting element (422*b*) and an upper end thereof supports a lower end of the upper frame (41). The location of the upper frame (41) may be vertically adjusted by the rotation of the screw rod (422*a*).

The lower frame (42) may include: a center bracket (421) fastened at a lower end of the lower frame (42), and configured such that the second ends of the connecting frames (5) are rotatably hinged thereto; and a second slide bracket (423) installed above the center bracket (421), and formed such that a second coupling hole (423*a*) is formed in a center thereof so that the second slide bracket (423) is selectively lifted and lowered vertically along the lower frame (42) and such that fourth hinge portions (423*b*) are formed along an outer wall thereof so that the second ends of the connecting frames (5) are rotatably hinged to the fourth hinge portions (423*b*).

The fourth hinge portions (423*b*) may include: first protruding portions formed to have a first thickness and to protrude radially and configured such that a first through hole having a first diameter is formed in a center of each of the first protruding portions; and second protruding portions formed to have a second thickness larger than the first thickness, to be spaced apart from the first protruding portions at predetermined intervals, and to protrude radially in parallel with the first protruding portions, and configured such that a second through hole having a second diameter smaller than the first diameter is formed in a center of each of the second protruding portions and such that a depression (g) is formed at a rear edge of a surface of each of the second protruding portions that faces a corresponding one of the first protruding portions.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

In the following detailed description of a folding hexagonal tent according to the present invention, the following description is not intended to limit the present invention to specific embodiments described herein. It should be appreciated that the present invention encompasses various modifications, equivalents, and/or alternatives.

In connection with the description of the drawings, similar reference symbols may be used for similar components. The terms "first" and "second" used herein may modify various components regardless of importance and/or order. The terms "first" and "second" are used merely to distinguish one component from another component, and do not limit the corresponding components.

For example, "a first portion" and "a second portion" may refer to different portions regardless of the order or importance thereof. For example, a first component may be named a second component without departing from the scope of the present invention, and vice versa.

Furthermore, the terms used herein are used merely to describe specific embodiments, and are not intended to limit the disclosure. Unless the context indicates otherwise, a singular expression may include a plural expression.

All the terms, including technical or scientific terms, used herein have the same meanings as terms commonly understood by those skilled in the art to which the present disclosure pertains, unless otherwise defined. The terms identical to those defined in dictionaries should be interpreted as having meanings identical to contextual meanings of the related art, and should not be interpreted as having ideal or excessively formal meanings, unless they are definitely defined herein. In some cases, it will be apparent that even a term defined herein should not be interpreted as excluding an embodiment of the present invention.

Figure 1:
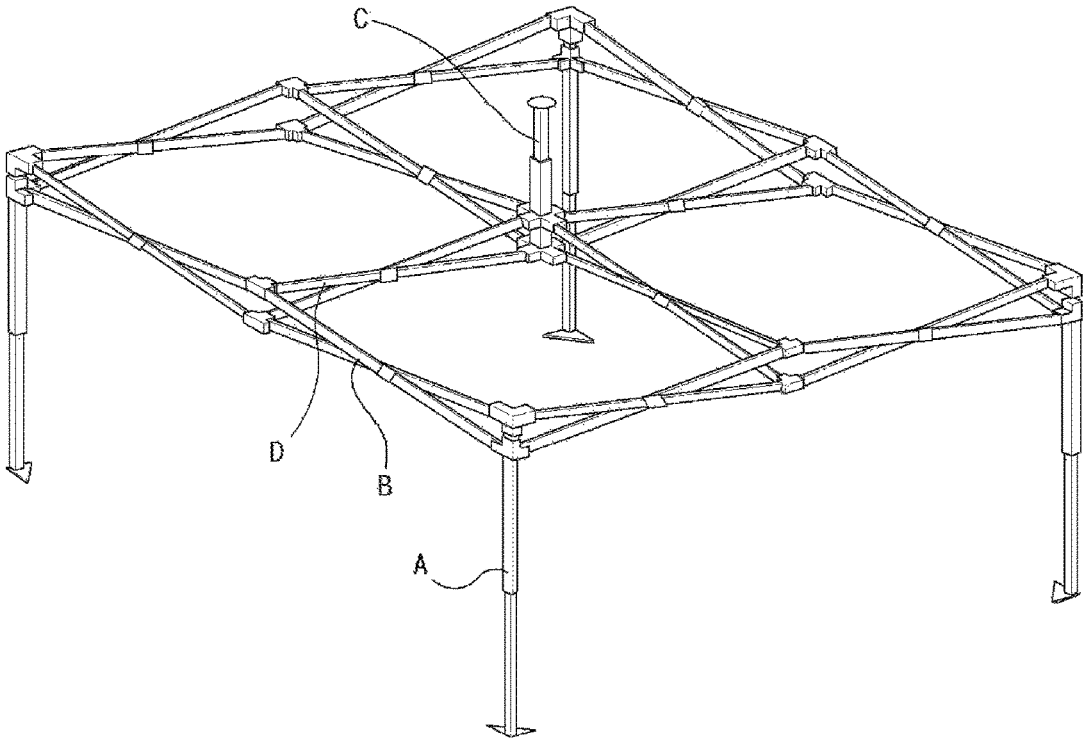
FIG. 1 is a perspective view showing the skeleton structure of a conventional folding tent.
Figure 2:
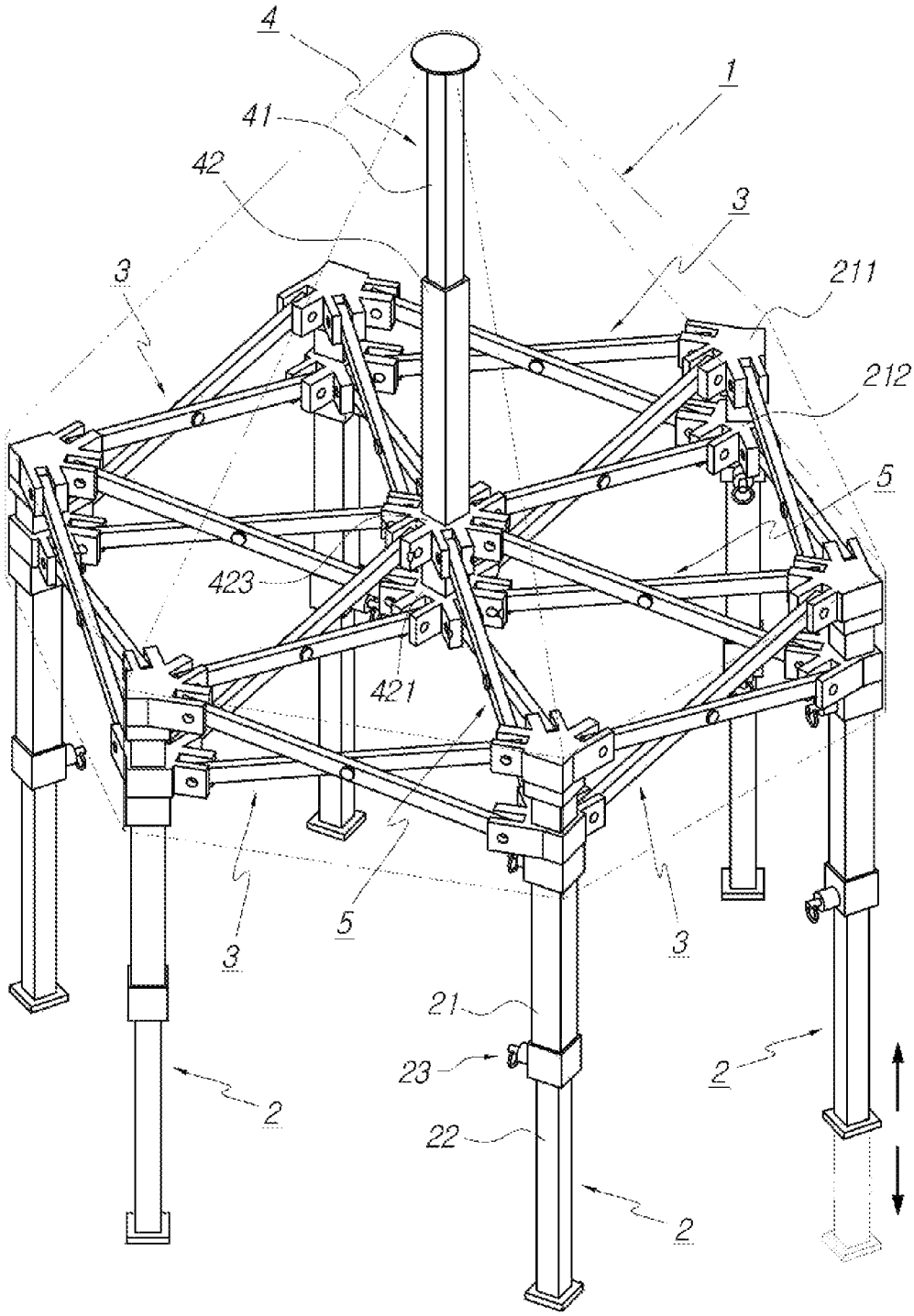
FIG. 2 is a perspective view showing an embodiment of a folding hexagonal tent according to the present invention.
Figure 3:
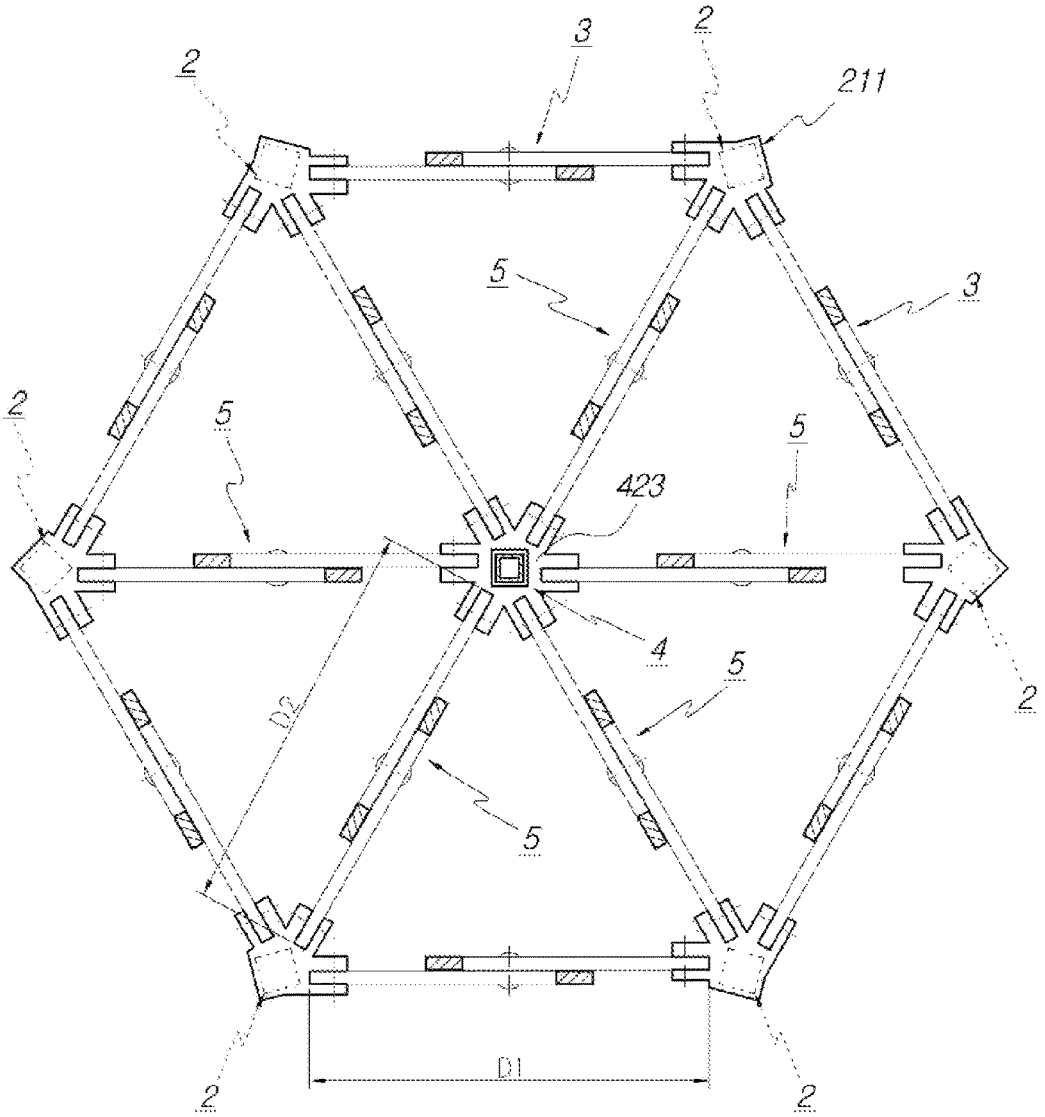
FIG. 3 is a plan view showing a skeleton structure according to the embodiment of the folding hexagonal tent of the present invention.
Figure 4:
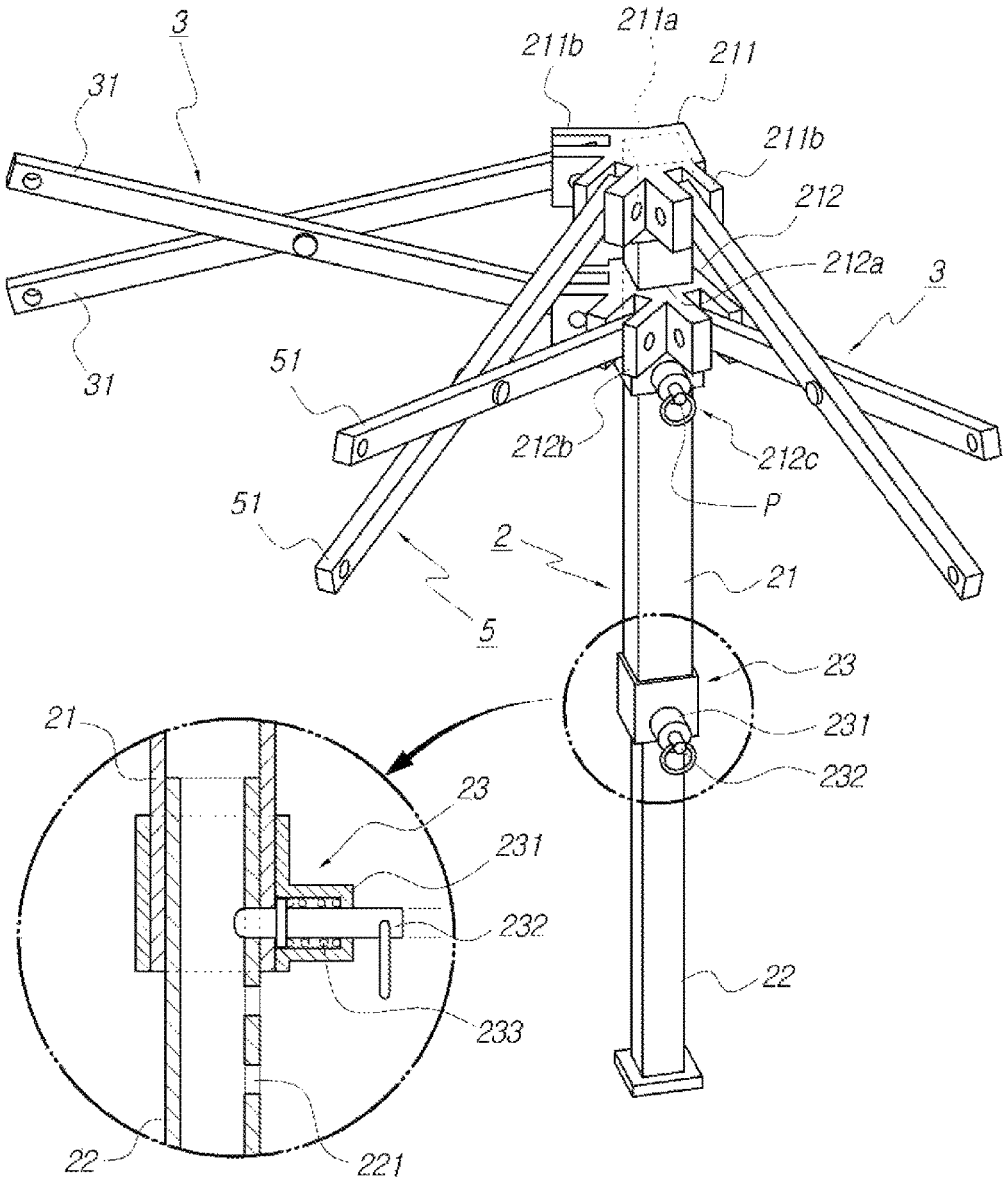
FIG. 4 is a perspective view showing coupling relationships between posts, side frames, and connecting frames according to the embodiment of the folding hexagonal tent of the present invention.
Figure 5:
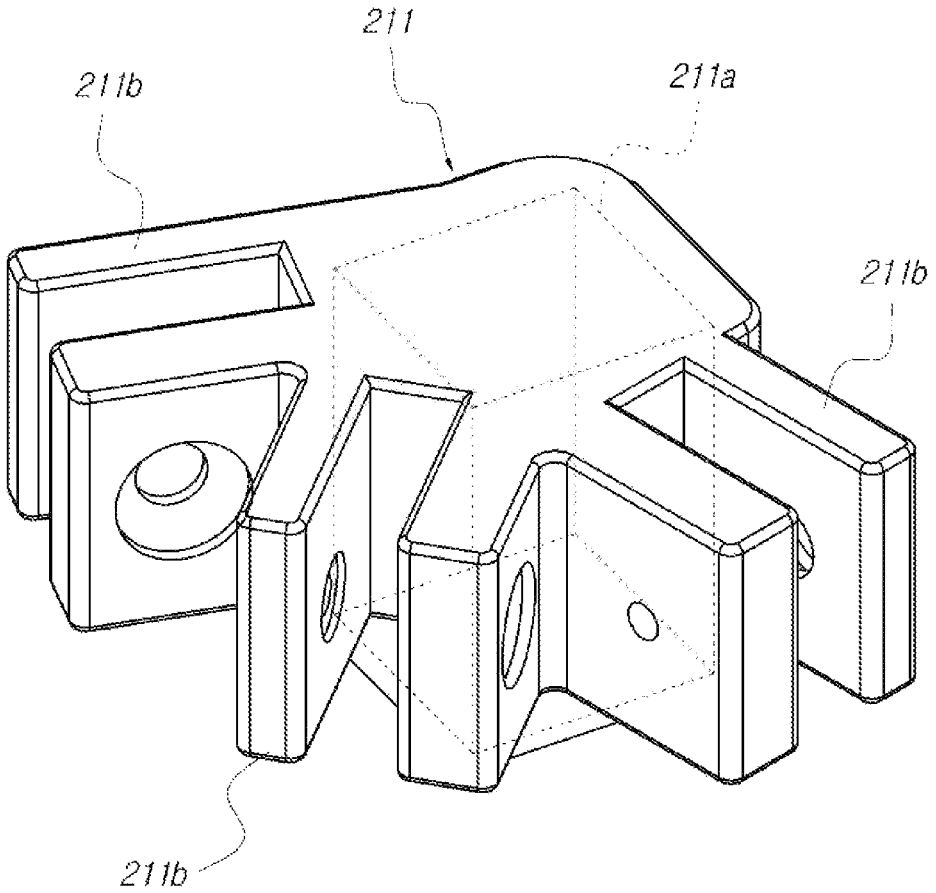
FIG. 5 is a perspective view showing a post bracket according to the embodiment of the folding hexagonal tent of the present invention.

FIG. 2 is a perspective view showing an embodiment of a folding hexagonal tent according to the present invention, FIG. 3 is a plan view showing a skeleton structure according to the embodiment of the folding hexagonal tent of the present invention, FIG. 4 is a perspective view showing coupling relationships between posts, side frames, and connecting frames according to the embodiment of the folding hexagonal tent of the present invention, FIG. 5 is a perspective view showing a post bracket according to the embodiment of the folding hexagonal tent of the present invention.

The following description will be given with reference to FIGS. 2 to 5.

The folding hexagonal tent according to the present invention includes a tent 1, posts 2, side frames 3, a roof frame 4, and connecting frames 5.

The posts 2 are disposed at the respective vertices of the tent formed into a hexagonal shape in its plan view, and each include an upper post 21 and a lower post 22 in order to support the tent on a support surface.

The upper post 21 has a larger diameter than the lower post 22, and thus the lower post 22 having a smaller diameter is accommodated inside the upper post 21 having a larger diameter in an antenna manner, so that the posts 2 may be selectively extended and retracted.

A first fastener 23 configured to fasten the lower post 22 that is introduced into the upper post 21 is preferably provided at the lower end of the bottom upper post 21.

The first fastener 23 is preferably configured such that a locking pin 232 is elastically installed inside a boss 231, fixedly disposed at the lower end of the upper post 21, by means of a coil spring 233 in a direction perpendicular to the longitudinal direction of the upper post 21.

Accordingly, when the lower post 22 is selectively inserted into and separated from the upper post 21, the inner end of the locking pin 232 slides along the outer surface of the lower post 22 and then the inner end of the locking pin 232 is elastically inserted into any one of through holes 221 formed along the lower post 22 at predetermined intervals, in which case the lower post 22 is fastened. Accordingly, the overall length of the post 2 may be adjusted by changing the location of the through hole 221 into which the locking pin 232 is inserted.

The upper post 21 includes a post bracket 211 and a first slide bracket 212.

The post bracket 211 includes a first coupling depression 211*a* and first hinge portions 211*b*.

An opening is formed downward in the first coupling depression 211*a* so that the upper end of the upper post 21 is inserted into the first coupling depression 211*a*.

Accordingly, the upper post 21 inserted into the first coupling depression 211*a* is fastened by introducing a fastening screw from the outer wall of the post bracket 211 in a direction perpendicular to the longitudinal direction of the upper post 21.

The three first hinge portions 211*b* are provided along the outer wall of the post bracket 211.

In this case, both side first hinge portions 211*b* are symmetrically formed at equal angles beside the first hinge portion 211*b* located at a center in a plan view.

As a result, an end of any one of a plurality of folding members constituting each of the side frames 3 is rotatably hinged to each of the both side first hinge portions, and an end of any one of a plurality of folding members constituting each of the connecting frames 5 is rotatably hinged to the center first hinge portion.

The first slide bracket 212 is disposed below the post bracket 211.

The first slide bracket 212 includes a first coupling hole 212*a*, second hinge portions 212*b*, and a second fastener 212*c*. The first coupling hole 212*a* is formed in a vertical direction so that the upper post 21 passes through the first coupling hole 212*a*, and thus the first slide bracket 212 may be selectively lifted and lowered along the upper post 21 in a vertical direction.

The three second hinge portions 212*b* are provided along the outer wall of the first slide bracket 212.

In this case, both side second hinge portions 212*b* are symmetrically formed at equal angles beside the first hinge portion 212*b* located at a center in a plan view.

As a result, an end of any one of a plurality of folding members constituting each of the side frames 3 is rotatably hinged to each of the both side second hinge portions, and an end of any one of a plurality of folding members constituting each of the connecting frames 5 is rotatably hinged to the center second hinge portion.

The second fastener 212*c* is preferably formed by elastically installing a locking pin P at the lower end of the first slide bracket 212 in a direction perpendicular to the longitudinal direction of the upper post 21, like the first fastener 23 formed at the lower end of the upper post 21.

Accordingly, when the first slide bracket 212 is moved in the up-down direction of the upper post 21, the inner end of the locking pin P slides along the outer surface of the upper post 21, and then the inner end of the locking pin P is elastically inserted into a through hole formed in the upper post 21, in which case the location of the first slide bracket 212 is fastened.

As a result, each of the side frames 3 and each of the connecting frames 5 that are foldable are fastened in the state of having been completely spread.

Accordingly, the posts 2 may be securely supported by a three-point support method in such a manner that two side frames 3 are coupled to both sides of each of the posts 2 and a connecting frame 5 is coupled at a location that bisects an angle formed by the two side frames 3 in a plan view.

The side frame 3 is foldable, and performs connection to selectively increase and decrease the distance between adjacent two posts 2.

In other words, the side frame 3 includes two folding member 31 that rotatably intersect each other in an "X" shape, and is thus foldable.

In this case, it will be apparent that a plurality of foldable side frames 3 may be connected in a longitudinal direction and used in an "XX" or "XXX" shape depending on the distance between adjacent two posts 2 over which the side frame 3 is disposed.

In the above-described construction of the side frames 3, when the side frames 3 each including a set of two folding members are used, overall weight may be reduced, but each of the folding members requires higher mechanical strength.

In contrast, when a plurality of side frames 3 is connected and used, the mechanical strength of folding members constituting each of the side frames 3 may be reduced, but overall weight is increased.

Figure 6:
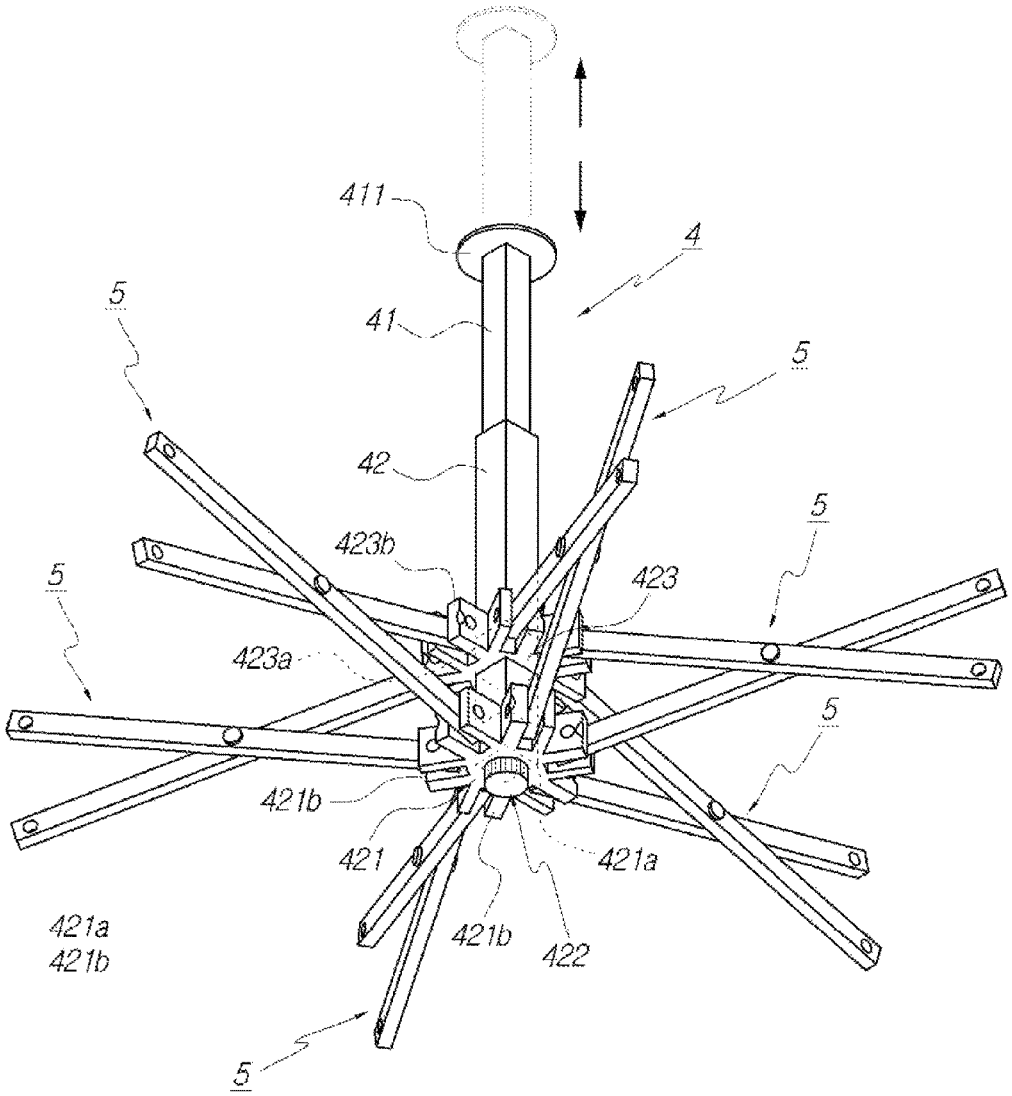
FIG. 6 is a perspective view showing coupling relationships between a roof frame and connecting frames according to the embodiment of the folding hexagonal tent of the present invention.
Figure 7:
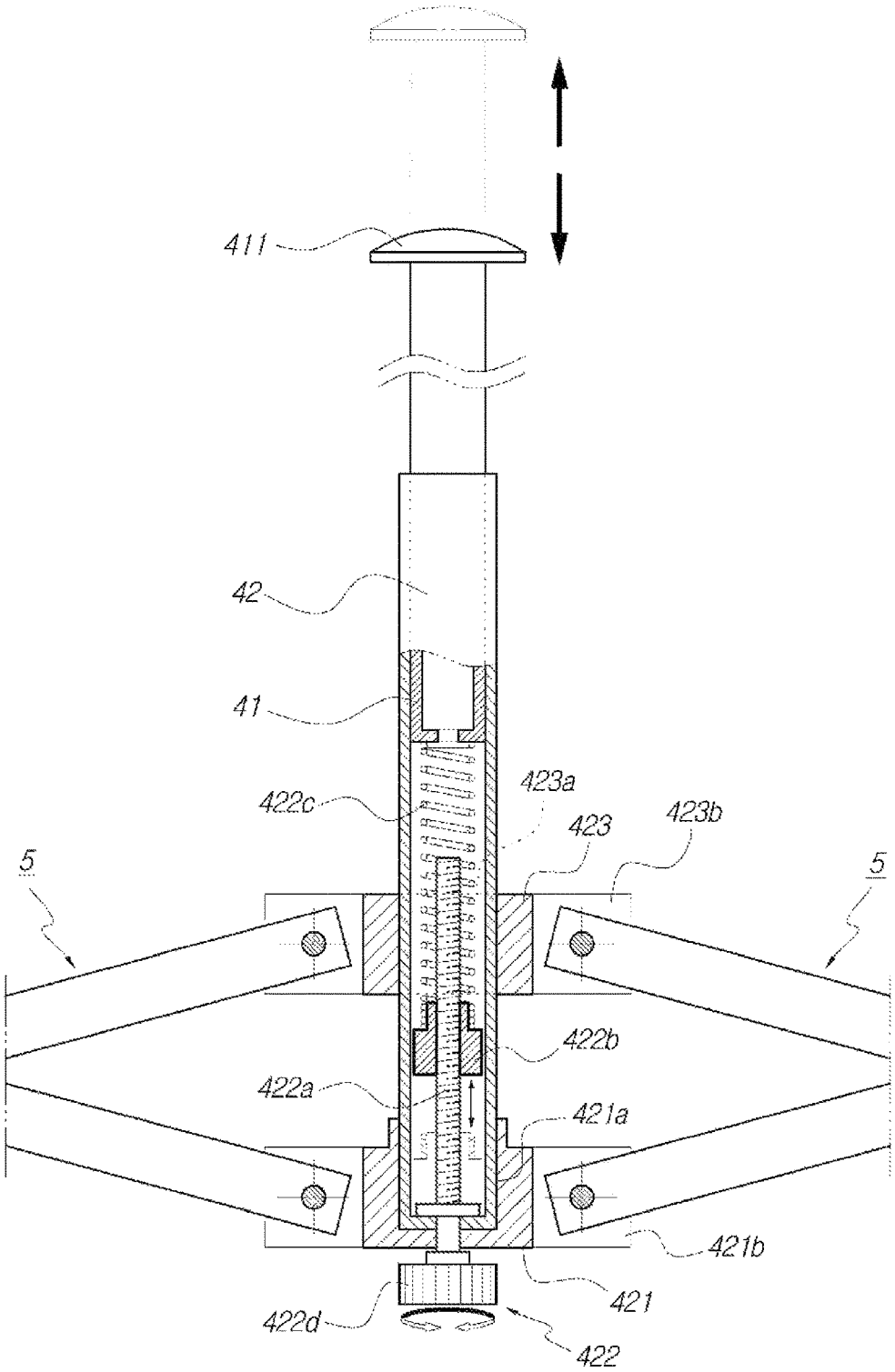
FIG. 7 is a partially sectional front view showing a height adjustment means according to the embodiment of the folding hexagonal tent of the present invention.
Figure 8:
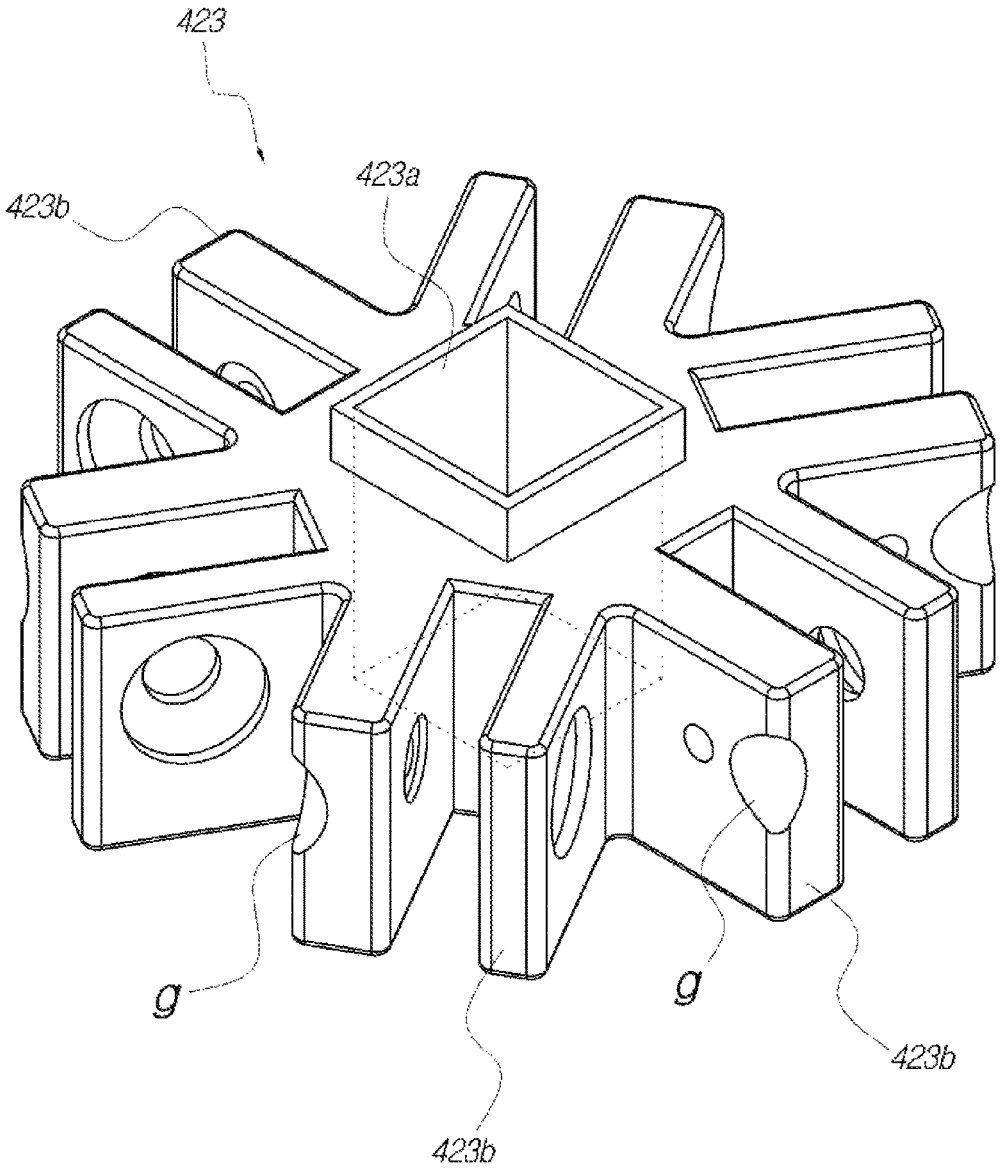
FIG. 8 is a perspective view showing a second slide bracket according to the embodiment of the folding hexagonal tent of the present invention.

FIG. 6 is a perspective view showing coupling relationships between a roof frame and connecting frames according to the embodiment of the folding hexagonal tent of the present invention, FIG. 7 is a partially sectional front view showing a height adjustment means according to the embodiment of the folding hexagonal tent of the present invention, and FIG. 8 is a perspective view showing a second slide bracket according to the embodiment of the folding hexagonal tent of the present invention.

The following description will be given with reference to FIGS. 2 to 8.

The roof frame 4 includes an upper frame 41 and a lower frame 42 in order to vertically support the center portion of the tent.

The upper frame 41 has a smaller diameter than the lower frame 42, and thus the upper frame 41 having a smaller diameter is accommodated inside the lower frame 42 having a larger diameter in an antenna manner, so that the roof frame 4 may be selectively extended and retracted.

Furthermore, a support cap 411 configured to support the tent by supporting the center portion of the tent is provided at the upper end of the upper frame 41.

The lower frame 42 includes a center bracket 421, a height adjustment means 422, and a second slide bracket 423.

The center bracket 421 is installed at the lower end of the lower frame 42.

The center bracket 421 includes a second coupling depression 421*a* and third hinge portions 421*b*. An opening is formed upward in the second coupling depression 421*a* so that the lower end of the lower frame 42 is inserted into the second coupling depression 421*a*.

Accordingly, the lower frame 42 inserted into the second coupling depression 421*a* is fastened by introducing a fastening screw from the outer wall of the center bracket 421 in a direction perpendicular to the longitudinal direction of the lower frame 42.

The six third hinge portions 421*b* are formed along the outer wall of the center bracket 421 radially in their plan view.

Therefore, an end of any one of a plurality of folding members constituting each of the radially disposed connecting frames 5 is rotatably hinged to each of the third hinge portions.

The height adjustment means 422 includes a screw rod 422*a*, a lifting element 422*b*, and a coil spring 422*c*.

The screw rod 422*a* is vertically installed at the lower end of the lower frame 42 so that it is idly rotatable, and the lower end of the screw rod 422*a* protrudes downward from the lower frame 42.

A grip 422*d* configured to enable a user to easily rotate the screw rod 422*a* is preferably provided at the lower end of the screw rod 422*a*.

The lifting element 422*b* is installed such that the lifting element 422*b* is coupled around the screw rod 422*a* in a screw manner and is selectively lifted and lowered inside the lower frame 42 by the rotation of the screw rod 422*a*.

The plane sectional shape of the lifting element 422*b* is preferably formed in the same polygonal shape as the plane sectional shape of the lower frame 42 so that the lifting element 422*b* is smoothly lifted or lowered by the rotation of the screw rod 422*a*.

The lower end of the coil spring 422*c* is fastened to the top portion of the lifting element 422*b*, and the upper end thereof supports the lower end of the upper frame 41.

Accordingly, when the tent 1 is shaken by a wind during the process of supporting the tent 1 by means of the support cap 411 installed at the upper end of the upper frame 41, the movement of the tent shaken by the wind is absorbed and mitigated in such a manner that the upper frame 41 is vertically vibrated by the elastic force of the coil spring 422*c* that supports the lower end of the upper frame 41.

Furthermore, when the screw rod 422*a* is rotated in a forward or reverse direction, the lifting element 422*b* coupled around the screw rod 422*a* in a screw manner is selectively lifted and lowered according to the direction in which the screw rod 422*a* is rotated, and thus the coil spring 422*c* fastened to the upper end of the lifting element 422*b* is selectively lifted and lowered along with the lifting element 422*b*.

In this case, the lower end of the upper frame 41 is seated at the upper end of the coil spring 422*c*, and thus the upper frame 41 is also selectively lifted and lowered by the selective lifting and lowering of the coil spring 422*c*.

Accordingly, the location of the upper frame 41 accommodated inside the lower frame 42 in an antenna manner may be adjusted in a vertical direction, and thus the tension state of the tent in which the lower end of the tent has been fastened to the posts 2 may be adjusted by the adjustment of the location of the center of the tent supported by the upper frame 41.

The second slide bracket 423 is installed above the center bracket 421.

The second slide bracket 423 includes a second coupling hole 423*a* and fourth hinge portions 423*b*.

The second coupling hole 423*a* is formed in a vertical direction so that the lower frame 42 passes through the second coupling hole 423*a*, and thus the second slide bracket 423 may be selectively lifted and lowered vertically along the lower frame 42.

The six fourth hinge portions 423*b* are formed along the outer wall of the second slide bracket 423 radially in their plan view.

Accordingly, an end of any one of a plurality of folding members constituting each of the connecting frames 5 is rotatably hinged to each of the fourth hinge portions.

Meanwhile, in the coupling of the ends of the folding members to the third and fourth hinge portions 421*b* and 423*b*, inwardly recessed depressions g may be formed on the outer ends of the third and fourth hinge portions 421*b* and 423*b* in order to avoid interference with another adjacent hinge portion.

Each of the connecting frames 5 is foldable, and performs connection to selectively increase and decrease the distance between the top of the corresponding one of the posts 2 and the bottom of the roof frame 4.

In other words, the connecting frame 5 includes two folding members 51 that rotatably intersect each other in an "X" shape, like the side frame 3, and is thus foldable.

In this case, it will be apparent that a plurality of foldable connecting frames 5 may be connected in a longitudinal direction and used in an "XX" or "XXX" shape depending on the distance between the top of the post 2 and the bottom of the roof frame 4.

Meanwhile, the length D1 of the side frames 3 is the same as the length D2 of the connecting frames 5.

In other words, as shown in FIG. 3, the lengths D1 of all the side frames 3 each connecting adjacent two posts 2 to each other in their plan view are made the same, and thus the shape formed by all the side frames 3 in its plan view forms a regular hexagonal shape.

Furthermore, the length D2 of the connecting frames 5 each connecting a corresponding one of the posts 2 and the roof frame 4 is formed to be the same as the length of the side frames 3.

The lengths of all the folding members constituting the foldable side frames 3 and connecting frames 5 are formed to be the same. Accordingly, when the side frames 3 and the connecting frame 5 are assembled and manufactured, all the folding members constituting the side frames 3 and the connecting frames 5 may be used in common for the side frames 3 and the connecting frames 5.

Therefore, when the side frames 3 and the connecting frame 5 are assembled and manufactured, it is not necessary to distinguish the lengths of the folding members from each other, and thus the convenience of assembly and manufacturing efficiency are considerably improved.

Figure 9:
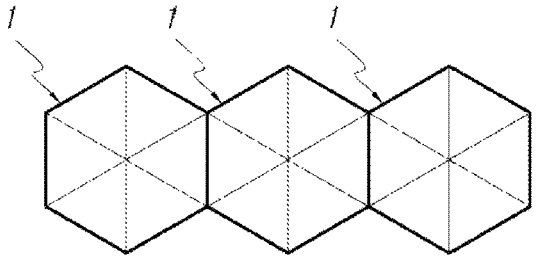
FIG. 9 shows plan views showing various installation patterns according to embodiments of the folding hexagonal tent of the present invention.
Figure 9:
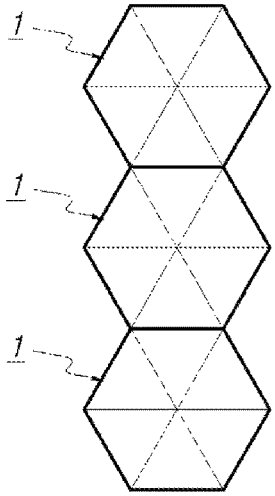
Figure 9:
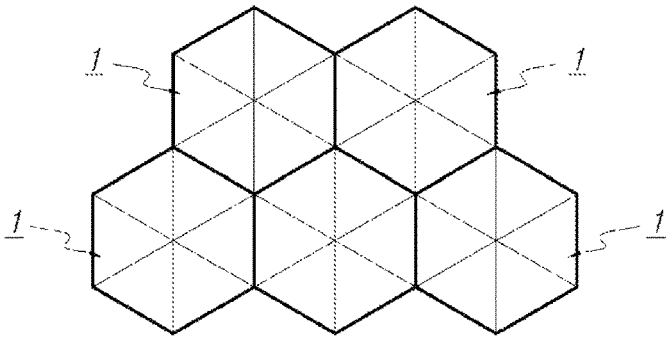

FIG. 9 shows plan views showing various installation patterns according to embodiments of the folding hexagonal tent of the present invention.

The following description will be given with reference to FIG. 9.

The folding hexagonal tent of the present invention is formed into a regular hexagonal shape in its plan view.

From the mathematical point of view, a hexagonal shape is a considerably useful shape. In other words, when a triangular shape, a rectangular shape, and a hexagonal shape are each constructed using a line having the same length, a shape having the largest area is the hexagonal shape.

Accordingly, the folding hexagonal tent according to the present invention provides a larger awning area and enables the more efficient use of the awning space than the conventional general rectangular tents.

Furthermore, when a plurality of tents is installed, the plurality of tents is completely spread and then disposed in close contact with one another, and thus the tents fit together closely without separation between tents, thereby facilitating the installation of a plurality of tents.

Moreover, when a plurality of tents is installed, a structure in which hexagonal shapes mesh with each other enables beautiful patterns to be constructed in various directions, such as vertical, horizontal and diagonal directions, thereby creating a variety of mysterious atmospheres.

As described above, the folding hexagonal tent according to the present invention has a secure skeleton structure because the side frames and the connecting frames are coupled to the posts and thus the posts are supported by means of a three-point support method, thereby providing the advantages of preventing a skeleton from being twisted and thus preventing the tent from easily falling down in strong winds.

Furthermore, the folding hexagonal tent according to the present invention is configured such that the side frames and the connecting frames that are foldable have the same length and thus the manufacture and assembly of the frames are facilitated, thereby providing the advantages of improving manufacturing efficiency and also reducing manufacturing cost.

Furthermore, the folding hexagonal tent according to the present invention enables a wide awning space to be formed, thereby providing the advantage of enabling the awning space to be efficiently utilized.

Moreover, the folding hexagonal tent according to the present invention enables a plurality of tents to be installed in close contact with one another in vertical, horizontal, and diagonal directions, thereby providing the advantage of enabling an awning space to be constructed in various forms.

The above description has been given based on the embodiments according to the present invention. The present invention is not limited to the above-described embodiments, and it will be apparent that various modifications may be made by those skilled in the art without departing from the scope of the technical spirit of the present invention. Although an operational effect according to a configuration of the present invention has not been explicitly described in the description of an embodiment of the present invention, it will be apparent that an effect that is expected based on the corresponding configuration should be also recognized.

What is claimed is:

1. A folding hexagonal tent, comprising:

posts (2) disposed on respective vertices of a tent formed in a hexagonal shape in a plan view, and configured to support the tent on a support surface;

side frames (3) formed in rectilinear shapes, and coupled such that both ends of each of the side frames (3) are hinged to adjacent two of the posts and such that the side frame (3) is connected to selectively increase and decrease a distance between the adjacent two posts (2);

a roof frame (4) configured to vertically support a center portion of the tent; and connecting frames (5) formed in rectilinear shapes, and coupled such that first ends thereof are hinged to respective tops of the posts (2) and second ends thereof are hinged to a bottom of the roof frame (4) and such that the connecting frames (5) are connected to selectively increase and decrease distances between the posts and the roof frame;

wherein the roof frame (4) is configured such that:

an upper frame (41) having a smaller diameter is accommodated inside a lower frame (42) having a larger diameter in an antenna manner, so that the roof frame (4) is selectively extended and retracted; and a height adjustment means (422) configured to vertically adjust a location of the upper frame (41) is provided at a lower end of the lower frame (42);

wherein the lower frame (42) comprises:

a center bracket (421) fastened at a lower end of the lower frame (42), and configured such that the second ends of the connecting frames (5) are rotatably hinged thereto; and a second slide bracket (423) installed above the center bracket (421), and formed such that a second coupling hole (423*a*) is formed in a center thereof so that the second slide bracket (423) is selectively lifted and lowered vertically along the lower frame (42) and such that fourth hinge portions (423*b*) are formed along an outer wall thereof so that the second ends of the connecting frames (5) are rotatably hinged to the fourth hinge portions (423*b*); and wherein the fourth hinge portions (423*b*) comprise:

first protruding portions formed to have a first thickness and to protrude radially and configured such that a first through hole having a first diameter is formed in a center of each of the first protruding portions; and second protruding portions formed to have a second thickness larger than the first thickness, to be spaced apart from the first protruding portions at predetermined intervals, and to protrude radially in parallel with the first protruding portions, and configured such that a second through hole having a second diameter smaller than the first diameter is formed in a center of each of the second protruding portions and such that a depression (g) is formed at a rear edge of a surface of each of the second protruding portions that faces a corresponding one of the first protruding portions.

2. The folding hexagonal tent of claim 1, wherein the posts (2) are supported by means of a three-point support method in such that:

two different ones of the side frames (3) are coupled to both sides of each of the posts (2); and a corresponding one of the connecting frames (5) is coupled at a location that bisects an angle formed by the two side frames (3) in a plan view.

3. The folding hexagonal tent of claim 1, wherein the side frames (3) and the connecting frames (5) are formed to have an identical length.

4. The folding hexagonal tent of claim 1, wherein the height adjustment means (422) comprises:

a screw rod (422*a*) vertically installed at a lower end of the lower frame (42) so that it is idly rotatable, and formed such that a lower end of the screw rod (422*a*) protrudes downward from the lower frame (42);

a lifting element (422*b*) installed such that the lifting element (422*b*) is coupled around the screw rod (422*a*) in a screw manner and is selectively lifted and lowered inside the lower frame (42) by rotation of the screw rod (422*a*); and a coil spring (422*c*) configured such that a lower end thereof is fastened to a top portion of the lifting element (422*b*) and an upper end thereof supports a lower end of the upper frame (41);

wherein a location of the upper frame (41) is vertically adjusted by the rotation of the screw rod (422*a*).

* * * * *